United States Patent [19]

Nikitas

[11] 4,360,245

[45] Nov. 23, 1982

[54] COAXIAL CONNECTOR

[75] Inventor: Nick C. Nikitas, Danvers, Mass.

[73] Assignee: Delta Electronics Mfg. Corp., Beverly, Mass.

[21] Appl. No.: 166,355

[22] Filed: Jul. 7, 1980

[51] Int. Cl.[3] ..... H01R 13/40

[52] U.S. Cl. ..... 339/218 R; 339/177 R

[58] Field of Search ..... 339/218, 220, 221, 177; 29/525

[56] References Cited

U.S. PATENT DOCUMENTS

| | | | |
|---|---|---|---|
| 2,208,030 | 7/1940 | Holmes | 339/218 S X |
| 2,774,812 | 12/1956 | Clark | 339/218 R X |
| 3,140,140 | 7/1964 | Kohler et al. | 339/218 R |
| 3,887,990 | 6/1975 | Wilson | 29/525 X |
| 4,041,240 | 8/1977 | Sipowicz | 339/218 M X |

*Primary Examiner*—Joseph H. McGlynn

*Attorney, Agent, or Firm*—Maurice R. Boiteau

[57] ABSTRACT

There is disclosed in the present application, a coaxial connector for microwave applications including an external conductive shell, a central conductor and an insulator of polytetrafluoroethylene (Teflon) or other non-conductive synthetic resin, interposed between the shell and the central conductor. The interior of the shell and the exterior of the central conductor are both roughened to provide an improved bond for a coat of epoxy resin adhesive which secures the shell and conductor to the insulator. For providing a superior anchor to the insulator, it is acid etched to roughen its epoxy contacting surfaces.

7 Claims, 3 Drawing Figures

28
16
23
30
26
24
10
14
32
22
20
12

COAXIAL CONNECTOR

The present invention relates generally to improvements in coaxial connectors for microwave applicatins and more particularly to such connectors including means for enhancing the resistance of the parts to separation under radial and axial forces.

A long standing problem in the field of coaxial connectors intended for microwave applications is the tendency of the parts to separate under the rough treatment and frequent assembly and disassembly to which connectors are subjected during their normal usage. In addition, the environment in which connectors are employed frequently includes adverse factors such as wide temperature variations, shock and vibration, which also contribute to the premature separation of the parts of connectors. As a result, various partial successful expedients have been tried in order to preserve the mechanical integrity of connectors. Many such expedients are partially successful in that they improve the resistance of the connector to the separation of its parts under the normal applicable forces but at a high cost in reduced electrical performance of the connector assembly. The deficiencies in electrical performance occurring as a result of such expedients are largely found in two separate areas. One of the problems is that of leakage which causes interference with nearby systems affected by the leaking radio frequency energy, a power loss, which may be tolerable, and reduced sensitivity in receiver circuits. The leakage generally is caused by constructions in which the outer shell is pierced in order to bond the component parts more intimately together. A second problem is that of high voltage standing wave ratios (vswr) originating from changes in cross-sectional areas and spacing of the components in some attempts to obtain greater resistance to separation of the parts of coaxial connectors. A high voltage standing wave ratio is undesirable because it effectively reduces power transmission through the line in which the offending connector is installed and also reduces the sensitivity of associated receiver circuits. Since the voltage standing wave ratio is proportional to the frequency of the transmitted signal, certain constructions which are appropriate at lower frequencies, become unacceptable as the operating frequency is increased.

It is accordingly an object of the present invention to improve the resistance of coaxial connectors to environmental forces without at the same time appreciably affecting their electrical performance.

Another object is to improve the mechanical integrity of coaxial connectors without changing the outward appearance of the connector in any way.

A further object is to provide a structurally improved connector without requiring extensive and expensive additional manufacturing operations to be performed in the production of the connector.

The foregoing objects are achieved according to a feature of the invention by a coaxial connector including a conductive outer shell which is interiorly roughened by forming a shallow thread-like pattern in its interior. A central conductor, which is another part of the connector is also roughened by rolling to form a similar thread-like pattern on its exterior. The roughening patterns on the shell and the central conductor provide an improved anchor for a coat of cement which secures the shell and conductor to an insulator interposed between them. In accordance with a related feature of the invention, the insulator, which is normally made of polytetrafluoroethylene (Teflon), is acid etched to roughen its cement receiving surfaces to further improve the bonding of the insulator to the shell and central conductor.

The above objects and features together with numerous benefits to be derived from the present invention will be more fully understood from the following detailed description of an illustrative embodiment taken in connection with the accompanying drawings in which.

Figures 1, 2, 3:
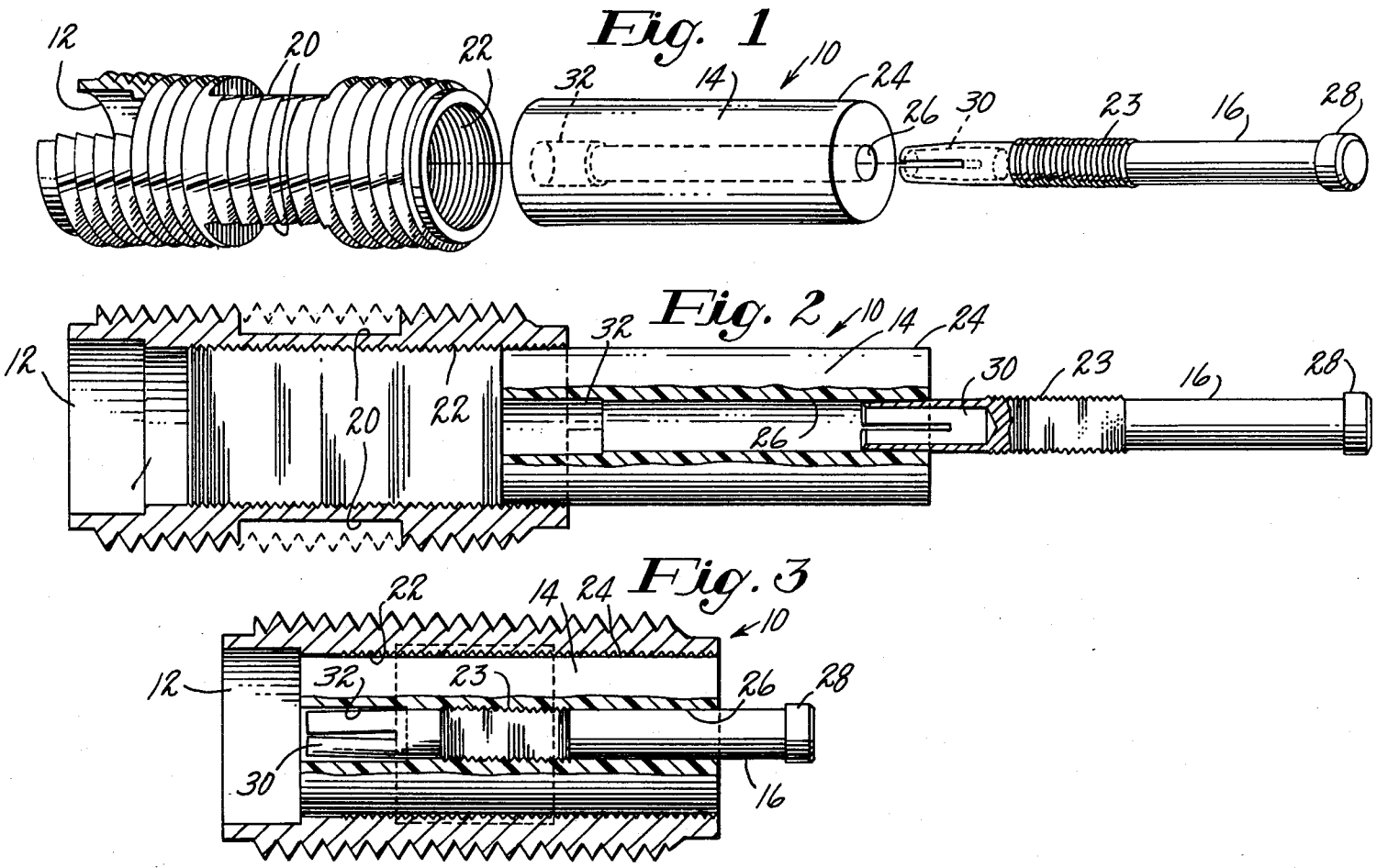
FIG. 1 is a view in perspective of a coaxial connector according to the present invention with the parts shown in separated relationship.
FIG. 2 is a view partly in longitudinal section of the connector of FIG. 1 showing the interior construction of the component parts, in the course of being assembled.
FIG. 3 is a view in longitudinal section showing the connector of FIGS. 1 and 2, fully assembled.

Turning now to the drawings, there is shown a coaxial connector assembly according to the present invention and indicated generally at 10. The assembly 10 comprises a generally tubular conductive outer shell 12, a tubular insulator 14 of Teflon or other non-conductive material and a central conductor 16. The shell 12 is externally threaded and may be milled to provide wrench engageable flats 20. In order to roughen its interior, the shell 20 is internally threaded with a tap sized approximately 0.004 inch larger than the internal diameter of the shell to form a shallow thread-like pattern which has negligible effect on the electrical performance of the connector but provides a superior anchor for a coat of epoxy resin adhesive which retains the insulator against displacement from within the shell. Similarly, the central conductor is also exteriorly roughened but without removing any of its material by a thread rolling operation which forms a thread-like pattern 23 on the conductor 16. The bonds between the insulator and the shell and also between the insulator and the central conductor are improved by etching the insulator in a special acid bath such as that sold under the the trade name "Tetra-Etch" by W. L. Gore and Associates of Newark, Del. The acid bath serves to roughen the exterior surfaces of the insulator, more particularly its exterior and interior diameters 24 and 26 respectively.

In the representative connector depicted in the drawings, the central connector is formed with a button enlargement 28 at one end and a slotted spring socket 30 at the other. In order to accommodate an expansion of the socket 30, the interior of the insulator is counterbored at 32. Accordingly, the roughening of the central connector 16 and bonding to the insulator occurs in a part of the distance between the bottom of the counterbore and the opposite end surface of the insulator. The length of bond is somewhat limited by the style requirements of certain connectors, but the present construction improves the resistance to separation of the components parts of a wide variety of sizes and styles of coaxial connectors.

The insulator is retained in the shell 12 by a coating of epoxy adhesive which is anchored in the roughened interior surface 22 of the shell and the etched exterior surface 24 of the insulator 14.

Having thus disclosed my invention, certain variations will become readily apparent to workers of ordinary skill in the connector art, such variations being well within the scope of the present invention. It is accordingly not intended that the specification and drawings be interpreted in a limiting sense but rather that the scope of the invention be measured by the accompanying claims.

What I claim as new and desire to secure by Letters Patent of the United States is:

1. A coaxial connector for microwave applications comprising an outer conductive shell having an internally roughened surface, an externally roughened inner conductor, a tubular insulator of synthetic resin interposed between the shell and the inner conductor, a layer of adhesive resin cement between the insulator and the shell and another layer of adhesive resin cement between the inner conductor and the insulator, the layers of adhesive cement being the sole bonds between their respective adjacent parts.

2. A coaxial connector according to claim 1 further characterized in that the roughened surface of the shell comprises a shallow thread-like pattern on the interior of the shell.

3. A coaxial connector according to claim 1 further characterized in that the inner conductor is roughened by a shallow thread-like pattern produced by rolling without removing any material from the inner conductor.

4. A coaxial connector according to claim 3 further characterized in that the shell is internally roughened by a shallow thread-like pattern.

5. A coaxial connector according to claim 1 further characterized in that the insulator is of polytetrafluoroethylene and is etched to provide an improved anchor for the layers of cement.

6. A coaxial connector according to claim 5 further characterized in that the cement is an epoxy resin.

7. A coaxial connector according to claim 6 further characterized in that both the outer shell and the inner conductor are internally roughened by thread-like patterns.

* * * * *